US009342035B2

(12) United States Patent
Sato

(10) Patent No.: US 9,342,035 B2
(45) Date of Patent: May 17, 2016

(54) IMAGE FORMING APPARATUS

(71) Applicant: BROTHER KOGYO KABUSHIKI KAISHA, Nagoya-shi, Aichi-ken (JP)

(72) Inventor: Shougo Sato, Seto (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/644,726

(22) Filed: Mar. 11, 2015

(65) Prior Publication Data

US 2015/0261173 A1 Sep. 17, 2015

(30) Foreign Application Priority Data

Mar. 14, 2014 (JP) ..... 2014-051280

(51) Int. Cl.
*G03G 21/12* (2006.01)
*G03G 21/18* (2006.01)
*G03G 21/10* (2006.01)

(52) U.S. Cl.
CPC ..... *G03G 21/12* (2013.01); *G03G 21/105* (2013.01); *G03G 21/1817* (2013.01); *G03G 2221/1853* (2013.01)

(58) Field of Classification Search
CPC ..... G03G 21/10; G03G 21/105; G03G 21/12; G03G 21/1803; G03G 21/1814; G03G 21/1817; G03G 21/1821; G03G 21/1825; G03G 2221/1853
See application file for complete search history.

(56) References Cited

U.S. PATENT DOCUMENTS

| | | | | |
|---|---|---|---|---|
| 5,126,799 | A * | 6/1992 | Matsuura et al. | 399/110 |
| 6,792,230 | B2 * | 9/2004 | Saito et al. | 399/111 |
| 2005/0002683 | A1 * | 1/2005 | Saito et al. | 399/107 |
| 2006/0216083 | A1 * | 9/2006 | Okoshi | 399/350 |
| 2009/0060568 | A1 * | 3/2009 | Ishikawa et al. | 399/111 |
| 2012/0275821 | A1 * | 11/2012 | Watanabe | 399/111 |
| 2014/0153971 | A1 * | 6/2014 | Swantner et al. | 399/258 |

FOREIGN PATENT DOCUMENTS

JP 2007-163529 A 6/2007

* cited by examiner

*Primary Examiner* — David Gray
*Assistant Examiner* — Carla Therrien
(74) *Attorney, Agent, or Firm* — Merchant & Gould P.C.

(57) ABSTRACT

There is provided an image forming apparatus including a main body, a process unit, an exposure unit, and a developing agent container unit. The main body includes a first end portion and a second end portion. The process unit is disposed at the first end portion and includes a photosensitive drum and a developing roller. The exposure unit is disposed at the second end portion and is configured to expose the photosensitive drum. An optical path of light irradiated from the exposure unit extends above the developing roller. The developing agent container unit includes a developing agent storage configured to store a developing agent and a waste developing agent storage configured to store the developing agent collected from a surface of the photosensitive drum. The developing agent container unit is disposed above the optical path and is detachably attachable to the process unit.

16 Claims, 11 Drawing Sheets

IMAGE FORMING APPARATUS

CROSS-REFERENCE TO RELATED APPLICATION

This application claims priority from Japanese Patent Application No. 2014-051280, filed on Mar. 14, 2014, which is incorporated herein by reference in its entirety.

TECHNICAL FIELD

Aspects disclosed herein relate to an image forming apparatus including a process unit including a photosensitive drum, an exposure unit for exposing a surface of the photosensitive drum with light, and a developing agent container unit containing a developing agent.

BACKGROUND

A known image forming apparatus includes a process unit and an exposure unit. The process unit includes a photosensitive drum and a developing agent storage. The exposure unit is disposed in front of the process unit and is configured to expose a surface of the photosensitive drum with light. The image forming apparatus further includes a waste developing agent storage for storing waste developing agent. The waste developing agent storage is disposed behind and adjacent to the developing agent storage.

SUMMARY

According to one or more aspects of the disclosure, an image forming apparatus may include a main body, a process unit, an exposure unit, and a developing agent container unit. The main body may include a first end portion and a second end portion. The process unit may be disposed at the first end portion of the main body and may include a photosensitive drum and a developing roller. The exposure unit may be disposed at the second end portion of the main body and may be configured to expose the photosensitive drum. An optical path of light irradiated from the exposure unit may extend above the developing roller. The developing agent container unit may include a developing agent storage configured to store a developing agent and a waste developing agent storage configured to store the developing agent collected from a surface of the photosensitive drum. The developing agent container unit may be disposed above the optical path and be detachably attachable to the process unit.

According to one or more other aspects of the disclosure, an image forming apparatus may include a main body, a process unit, an exposure unit, and a developing agent container unit. The main body may include a first end portion and a second end portion. The process unit may be disposed at the first end portion of the main body and may include a photosensitive drum and a developing roller. The exposure unit may be disposed at the second end portion of the main body and may be configured to expose the photosensitive drum. The developing agent container unit may include a developing agent storage configured to store a developing agent and a waste developing agent storage configured to store the developing agent collected from a surface of the photosensitive drum. The developing agent container unit may be disposed above the optical path and be detachably attachable to the process unit. A space through which light irradiated from the exposure unit passes may be formed above the developing roller and below the developing agent container unit which includes the developing agent storage and the waste developing agent storage.

According to one or more other aspects of the disclosure, an image forming apparatus may include a main body, a process unit, an exposure unit, and a developing agent container unit. The main body may include a first end portion and a second end portion. The process unit may be disposed at the first end portion of the main body and may include a photosensitive drum and a developing roller. The exposure unit may be disposed at the second end portion of the main body and may be configured to expose the photosensitive drum. The developing agent container unit may include a developing agent storage configured to store a developing agent and a waste developing agent storage configured to store the developing agent collected from a surface of the photosensitive drum. The developing agent container unit may be detachably attachable to the process unit. An exposed position on the photosensitive drum, which is exposed by the exposure unit, may be positioned above the developing roller and below the developing agent container unit which includes the developing agent storage and the waste developing agent storage.

DESCRIPTION OF THE DRAWINGS

Aspects of the disclosure are illustrated by way of example and not by limitation in the accompanying figures in which like reference characters indicate similar elements.

DETAILED DESCRIPTION

For a more complete understanding of the present disclosure, needs satisfied thereby, and the objects, features, and advantages thereof, reference now is made to the following descriptions taken in connection with the accompanying drawings. Hereinafter, illustrative embodiments of the disclosure will be described in detail with reference to the accompanying drawings.

In the description below, a general configuration of a laser printer 1 will be described and then features of the disclosure will be described. The laser printer 1 is an example of an image forming apparatus.

Figure 1:
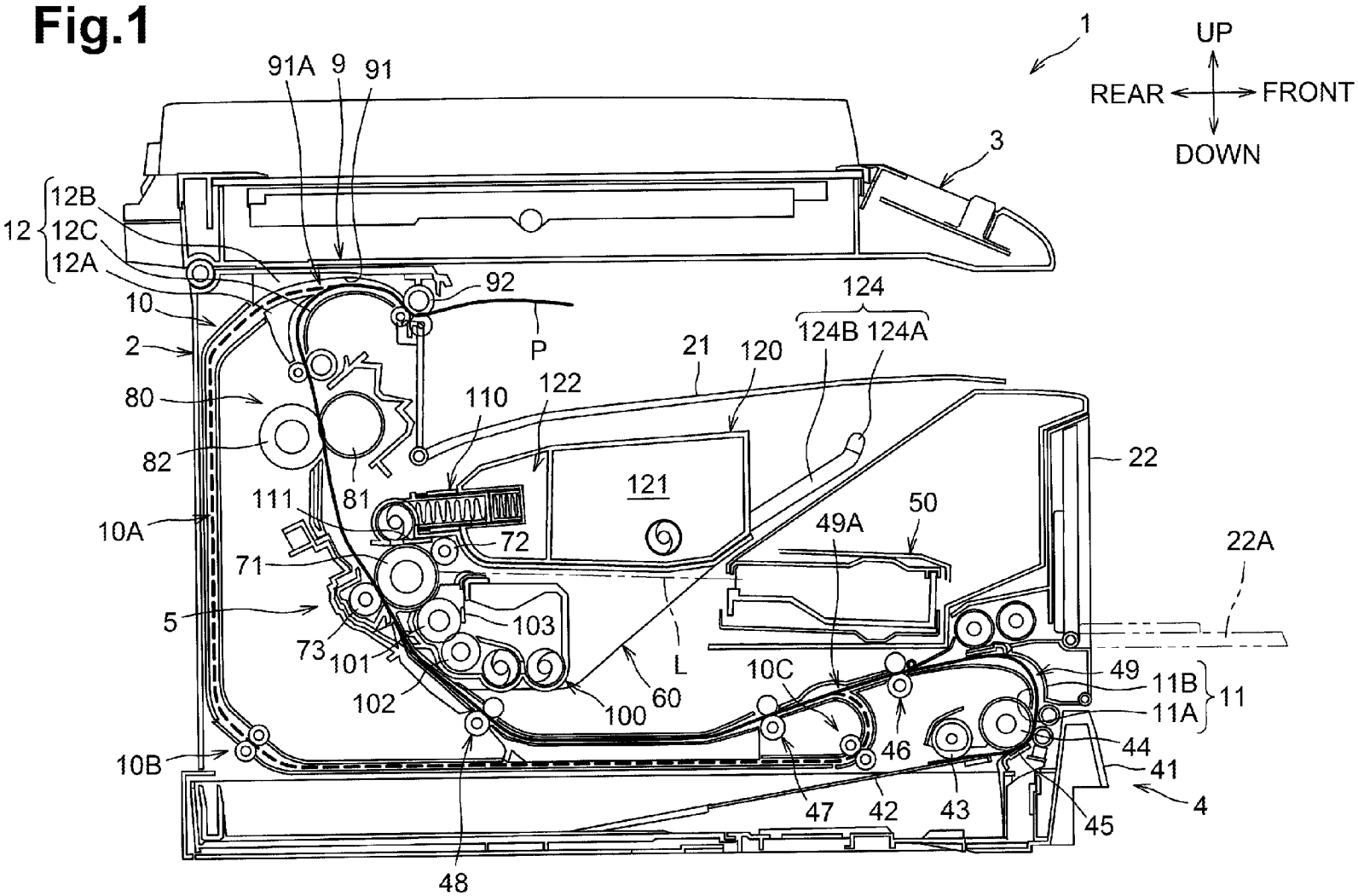
FIG. 1 is a schematic diagram depicting a configuration of a laser printer in an illustrative embodiment according to one or more aspects of the disclosure.

With reference to the laser printer 1, directions of up, down, right, left, front, and rear are defined with reference to an orientation of the laser printer 1 that is disposed in which it is intended to be used as depicted in FIG. 1.

<General Configuration of Laser Printer>

As depicted in FIG. 1, the laser printer 1 is configured to form images on both sides of a sheet P. The laser printer 1 includes a main body 2 and a flatbed scanner 3. The flatbed scanner 3 is disposed above the main body 2. The laser printer 1 further includes a feeding unit 4, an image forming unit 5, a discharge unit 9, and a return unit 10 within the main body 2.

The main body 2 includes a top cover 21 and a front cover 22. The top cover 21 is disposed at the top of the main body 2 so as to be pivotable. When the top cover 21 is opened, the top cover 21 exposes an opening 21A and allows a process unit 60 to be attached to or detached from the main body 2 via the opening 21A (refer to FIG. 2).

The front cover 22 is disposed at the front of the main body 2. (refer to FIG. 2). The front cover 22 includes a manual feed tray 22A for supporting one or more sheets P thereon. In a state where the front cover 22 is opened, the front cover 22 functions as the manual feed tray 22A. A sheet P is an example of a recording sheet.

The flatbed scanner 3 may be a document reader having a known configuration. The flatbed scanner 3 is configured to read an image from a document by irradiating the document with light and to generate image data based on the read image at the time of copying. The flatbed scanner 3 is disposed above the main body 2. The flatbed scanner 3 is disposed above the top cover 21 while being spaced apart from each other. The flatbed scanner 3 is configured to pivot on an axis that is positioned closer to the rear than the top cover 21.

The feeding unit 4 is configured to feed one or more sheets P to the image forming unit 5. The feeding unit 4 is disposed in a lower portion of the main body 2. The feeding unit 4 includes a feed tray 41, a sheet pressing plate 42, a pickup roller 43, a separation roller 44, a separation pad 45, a first conveyor roller pair 46, a second conveyor roller pair 47, and a registration roller pair 48, which define a feeding path 49.

The feeding path 49 is a route for conveying a sheet P fed from the feed tray 41 to the image forming unit 5, more specifically, to between the photosensitive drum 61 and the transfer roller 63. The feeding path 49 extends obliquely upward toward the front from a vicinity of the pickup roller 43 and is then curved toward the rear. The feeding path 49 further extends toward the rear so as to direct a sheet P to between the photosensitive drum 61 and the transfer roller 63. A portion of the feeding path 49 is concavely curved between the second conveyor roller pair 47 and the registration roller pair 48, more specifically, below the process cartridge 60.

The feeding path 49 is defined by a first guide 11. The first guide 11 includes a lower guide portion 11A and an upper guide portion 11B. The lower guide portion 11A includes a lower wall that defines the feeding path 49 from below. The upper guide portion 11B includes an upper wall that defines the feeding path 49 from above.

The feed tray 41 supports one or more sheets P thereon. The sheet pressing plate 42 moves the one or more sheets P toward the pickup roller 43 and the pickup roller 43 picks and feeds the one or more sheets P. The separation roller 44 and the separation pad 45 separate and convey, one by one, the one or more fed sheets P in conjunction with each other. The separated sheet P is bent into a generally U-shape at the front portion of the main body 2. Then, the first conveyor roller pair 46 and the second conveyor roller pair 47 further convey the sheet P. Thereafter, the registration roller pair 48 corrects skewing of the sheet P and further conveys the sheet P toward the image forming unit 5 (e.g., the process unit 60).

The image forming unit 5 is configured to form an image onto the fed sheet P. The image forming unit 5 is disposed above the feed tray 41 and below the top cover 21. The image forming unit 5 includes an exposure unit 50, the drum cartridge 60, and a fixing unit 80.

The exposure unit 50 is disposed in a front end portion (e.g., a second end portion) of the main body 2. The exposure unit 50 includes a laser-emitting portion, a polygon mirror, and lenses (not depicted). The exposure unit 50 performs high-speed scanning to irradiate a surface of the photosensitive drum 61 with a laser beam which travels in an optical path L as indicated by a dotted-and-dashed line in FIG. 1 when the process cartridge 60 is attached in the main body 2.

The process unit 60 is positioned in a rear end portion (e.g., a first end portion) of the main body 2. The process unit 60 is configured to move to the outside of the main body from an attached position (e.g., a position of the process unit 60 depicted in FIG. 1). The process unit 60 includes a photosensitive drum 71, a charging roller 72, a transfer roller 73, a developing roller 101, a supply roller 102, a layer thickness regulating blade 103, and a toner storage 121. The toner storage 121 is configured to store toner therein. The toner storage 121 is an example of a developing agent storage. The detail of the process unit 60 will be described later.

The fixing unit 80 is disposed above a rear end portion of the process unit 60. The fixing unit 80 includes a heating roller 81 and a pressing roller 82. The pressing roller 82 faces the heating roller 81 and presses the heating roller 81.

In the image forming unit 5, the charging roller 72 charges the surface of the photosensitive drum 71 uniformly. Then, the exposure unit 50 performs high-speed scanning to expose the charged surface of the photosensitive drum 71 with a laser beam. Thus, an electrostatic latent image is formed on the surface of the photosensitive drum 71. The supply roller 102 supplies toner to the developing roller 101 from the toner storage 121, and the developing roller 101 carries the toner thereon.

Then, the developing roller 101 supplies the toner onto the electrostatic latent image held on the surface of the photosensitive drum 71, thereby visualizing the electrostatic latent image to form a toner image on the surface of the photosensitive drum 71. Thereafter, the transfer roller 73 transfers the toner image onto a sheet P from the surface of the photosensitive drum 71 when the sheet P fed from the feeding unit 4 passes between the photosensitive drum 71 and the transfer roller 101. When the sheet P passes between the heating roller 81 and the pressing roller 82, the heating roller 81 and the pressing roller 82 thermally fix the transferred toner image onto the sheet P.

The discharge unit 9 is configured to convey a sheet P having a thermally-fixed toner image to the outside of the main body 2. The discharge unit 9 includes a discharge roller 92 and defines a discharging path 91.

The discharging path 91 is a route for guiding, toward the top cover 21, a sheet P conveyed from the image forming unit 5, while bending the sheet P into a generally U-shape. The top cover 21 is disposed above the process unit 60. The top cover 21 functions as a discharge tray when the top cover 21 is closed. The discharging path 91 is defined by a second guide 12. The second guide 12 includes an upper upstream guide portion 12A, an upper downstream guide portion 12B, and a lower guide portion 12C. The upper upstream guide portion 12A and the upper downstream guide portion 12B include upper walls that define the discharging path 91 from above. The lower guide portion 12C includes a lower wall that defines the discharging path 91 from below. The upper upstream guide portion 12A is configured to guide a sheet P at a position upstream of a junction 91A between the discharging path 91 and a return path 10A in a sheet conveying direction. The upper downstream guide portion 12B is configured to guide a sheet P at a position downstream of the junction 91A in the sheet conveying direction.

The discharge unit 9 conveys a sheet P, which has an image thereon and has passed the image forming unit 5 (e.g., the process unit 60), while bending the sheet P into a generally U-shape in the rear portion (e.g., a side on which the process unit 60 is disposed) of the main body 2. After image formation is completed on a particular side of a sheet P (e.g., a single-sided recording) or on both sides of a sheet P (e.g., a double-sided recording), the sheet P is discharged to the outside of the main body 2 and thus is placed on the top cover 21.

In a case where images are formed on both sides of a sheet P, the discharge roller 92 rotates in a normal direction to convey a sheet P toward the outside of the main body 2. Before an entire portion of the sheet P is discharged to the outside of the main body 2, the rotating direction of the discharge roller 92 is changed. That is, the discharge roller 92 rotates in a reverse direction to draw the sheet P into the inside of the main body 2 again and conveys the sheet P to the return unit 10 (e.g., indicated in a dashed line in FIG. 1).

The return unit 10 is configured to convey an upside-down sheet P having an image on one side thereof again toward the image forming unit 5 for forming an image on the other side of the sheet P. The return unit 10 includes a return path 10A and return roller pairs 10B and 10C.

The return path 10A is a route for guiding a sheet P having an image on one side toward the feeding path 49 by reverse rotation of the discharge roller 92. More specifically, the return path 10A extends downward from an end of the discharging path 91 at the junction 91A. The return path 10A is then curved toward the front and further extends frontward to the front return roller pair 10C while passing the rear return roller pair 10B and above the feed tray 41. The return path 10A further extends curvedly upward from the front return roller pair 10C and meets the feeding path 49 at a junction 49A while making a U-turn.

The return unit 10 conveys a sheet P to the feeding path 49 by the reverse rotation of the discharge roller 92 along the return path 10A (e.g., indicated by the dashed line). The sheet P conveyed into the feeding path 49 is then further conveyed to the image forming unit 5 along the feeding path 49. Thereafter, the image forming unit 5 forms an image on the other side of the sheet P and the discharge unit 9 discharges the sheet P to the outside of the main body 2 (e.g., indicated by the solid line). Thus, the discharged sheet P is placed on the top cover 21.

<Detailed Configuration of Process Unit>

Hereinafter, the process unit 60 will be described in detail.

Figure 3:
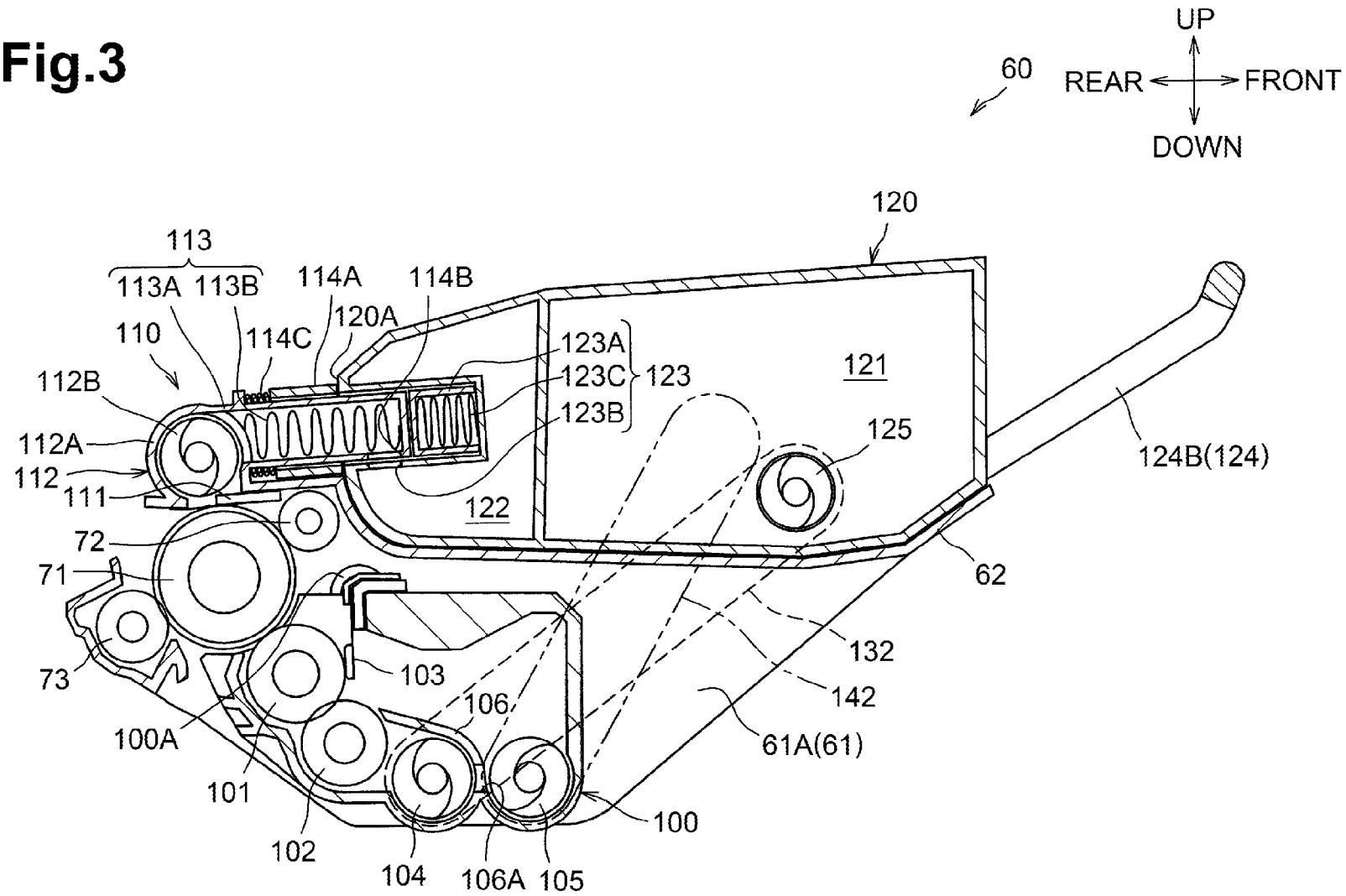
FIG. 3 is a sectional view of a process unit in which a toner container unit is attached in the illustrative embodiment according to one or more aspects of the disclosure.

As depicted in FIG. 3, the process unit 60 includes a developer unit 100, a cleaning unit 110 and a toner container unit 120. The toner container unit 120 is an example of a developing agent container unit.

The process unit 60 includes a pair of side plates 61 including a right side plate 61A and a left side plate 61C (only the right side plate 61A is depicted in FIG. 3) and a connecting plate 62. The side plates 61A and 61B are configured to support the photosensitive drum 71 and the developer unit 100 from respective sides in a right-left direction (e.g., an axial direction) of the photosensitive drum 71.

Figure 7:
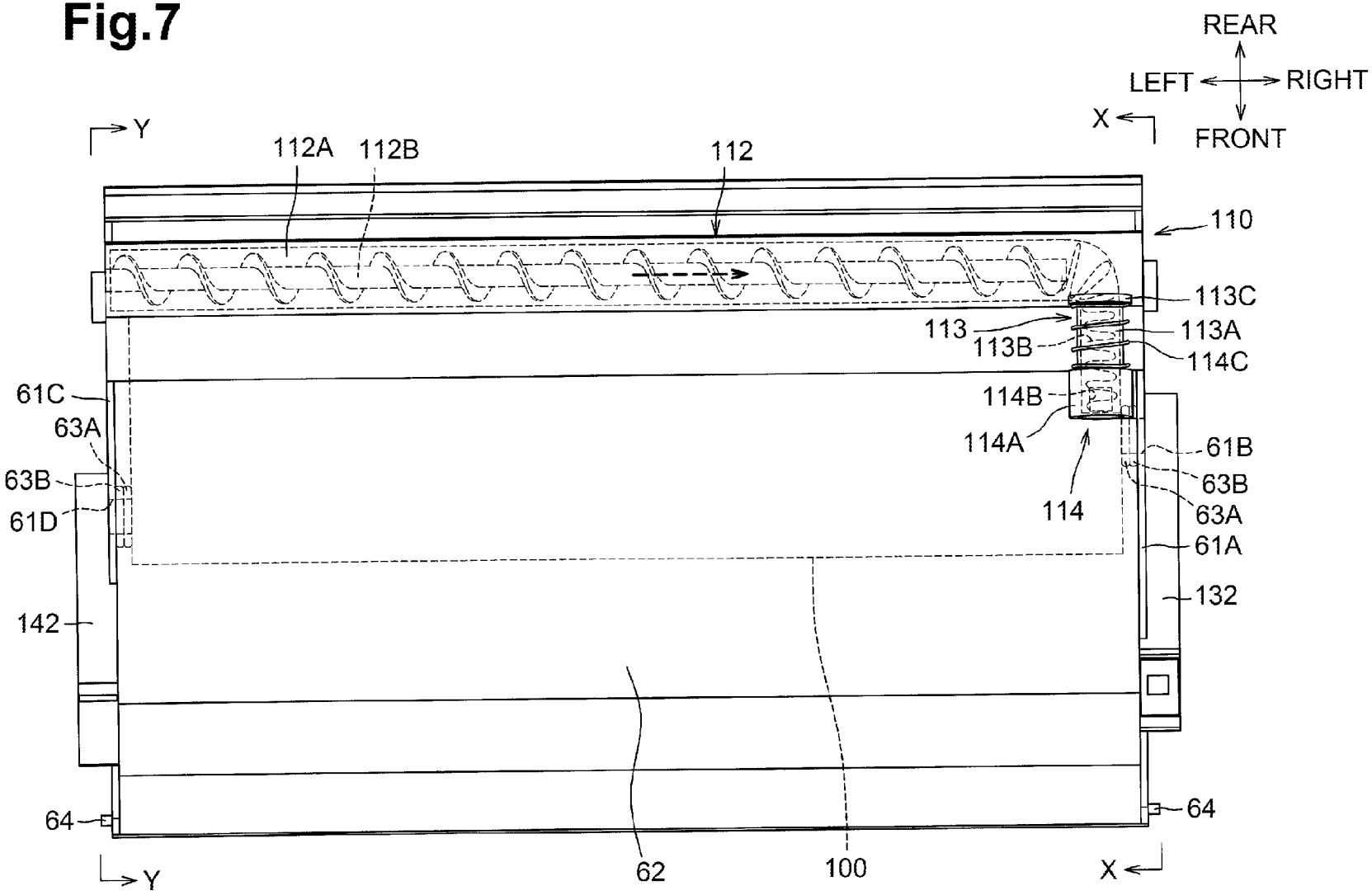
FIG. 7 is a top plan view depicting the process unit from which the toner container unit is removed in the illustrative embodiment according to one or more aspects of the disclosure.

As depicted in FIG. 7, the right side plate 61A has an inlet 61B that allows a supply pipe 132 and the developer unit 100 to communicate with each other. The left side plate 61C has an outlet 61D that allows a return pipe 142 and the developer unit 100 to communicate with each other.

As depicted in FIG. 3, the connecting plate 62 connects upper end portions of the side plates 61A and 61B each other. The toner container unit 120 is disposed on an upper surface of the connecting plate 62.

Figure 4:
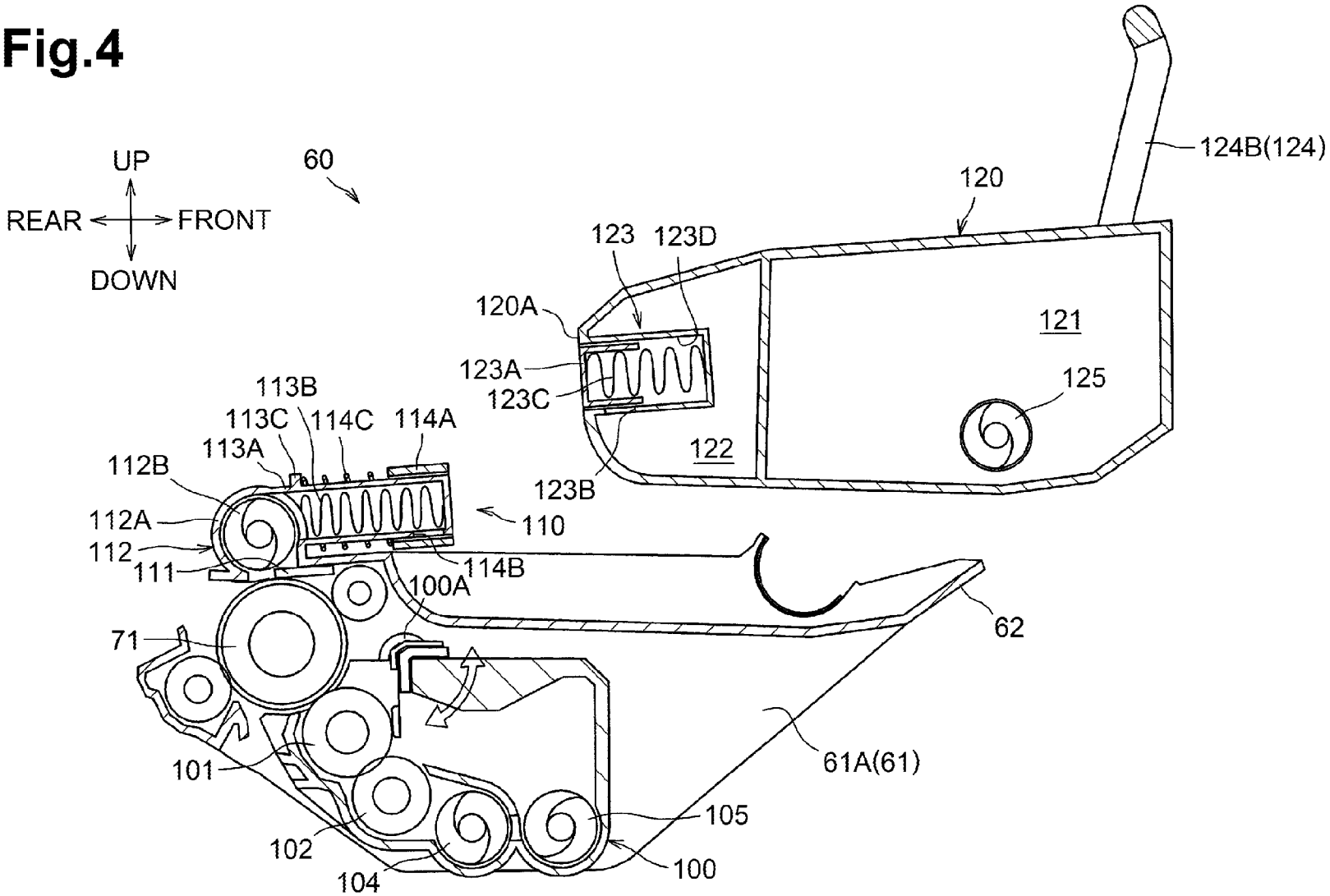
FIG. 4 is a sectional view of the process unit from which the toner container unit is removed in the first illustrative embodiment according to one or more aspects of the disclosure.

As depicted in FIG. 1, the developer unit 100 is disposed below the optical path L of light irradiated from the exposure unit 50. With this arrangement, a surface of light irradiated from the exposure unit 50 is positioned higher than the developing roller 101. As depicted in FIG. 4, the developer unit 100 includes a pivot shaft 100A at upper right and left end portions thereof. The developer unit 100 is supported by the side plates 61A and 61B via the respective pivot shafts 100A, thereby being pivotable with respect to the process unit 60. The developer unit 100 is configured such that the developing roller 101 is urged against the photosensitive drum 71 by an urging member (not depicted), e.g., a spring. In other embodiments, for example, the developer unit 100 may be configured to be attachable to and detachable from the side plates 61A and 61B.

Figure 5:
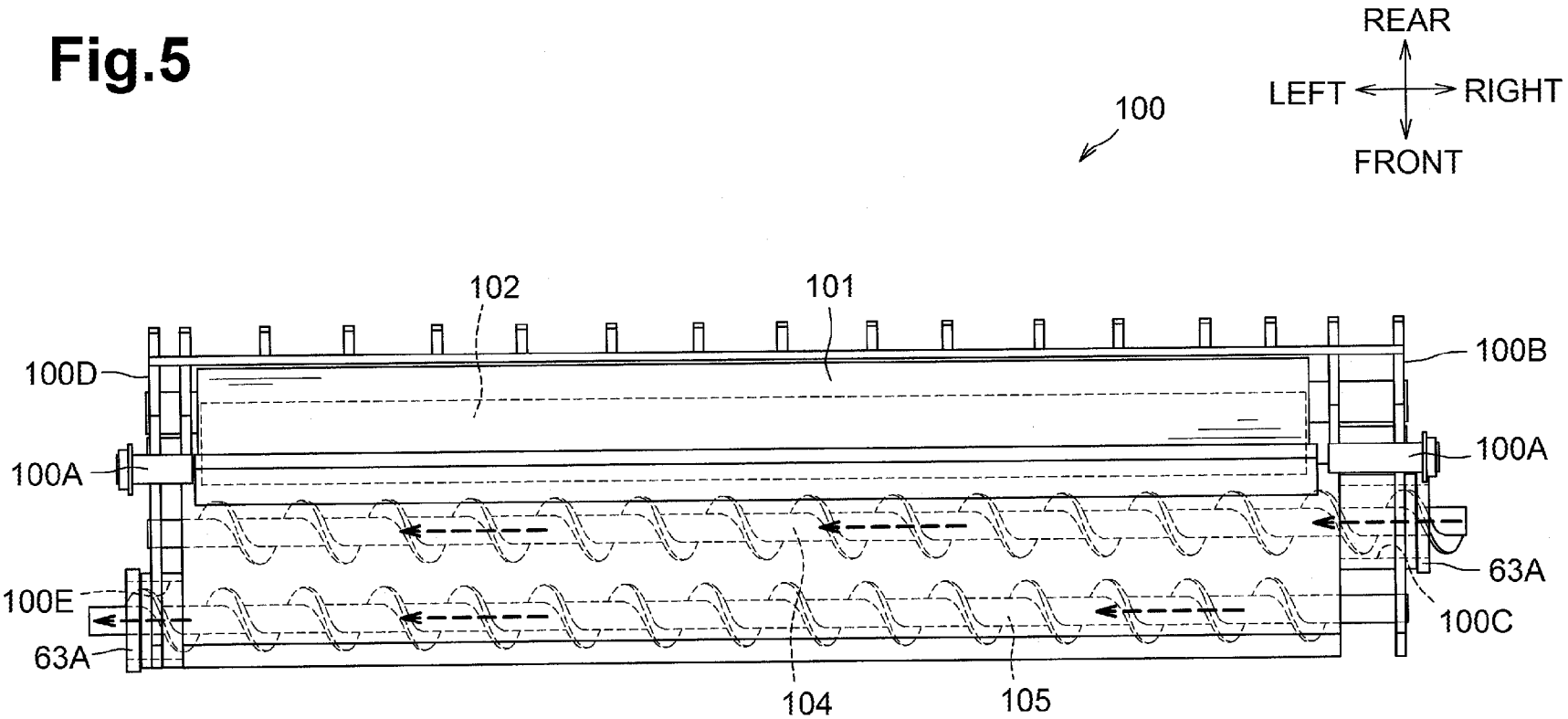
FIG. 5 is a top plan view depicting a developer unit in the illustrative embodiment according to one or more aspects of the disclosure.

As depicted in FIG. 5, the developer unit 100 includes a right side surface 100B and a left side surface 100D. The developer unit 100 has an inlet 100C in the right side surface 100B. The inlet 100C allows the supply pipe 132 and the developer unit 100 to communicate with each other. The developer unit 100 has an outlet 100E in the left side surface 100D. The outlet 100E allows the return pipe 142 and the developer unit 100 to communicate with each other.

The inlet 100C is defined in a portion corresponding to the inlet 61B of the right side plate 61A. The inlet 100C enables toner to pass therethrough for supplying toner to the developer unit 100 from the toner storage 121 via the inlet 61B. The outlet 100E is defined in another portion corresponding to the outlet 61D of the left side plate 61C. The outlet 100E enables toner to pass therethrough for returning toner to the toner storage 121 from the developer unit 100 via the outlet 61D.

The developer unit 100 includes a first auger 104 and a second auger 105. The first auger 104 is disposed at a position corresponding to the inlet 100C. The second auger 105 is disposed at a position corresponding to the outlet 100E.

The first auger 104 includes a shaft extending in the right-left direction with a helical ridge running around the outside of the shaft. The first auger 104 is disposed in front of the supply roller 102 so as to face the supply roller 102. The first auger 104 extends across the supply roller 102 in the right-left direction, and is configured to convey toner supplied via the right inlet 100C toward the left as the first auger 104 rotates. Thus, the first auger 104 is capable of supplying toner to an entire portion of the supply roller 102.

The second auger 105 has a configuration similar to the first auger 104. The second auger 105 is disposed in front of the first auger 104 so as to face the first auger 104. The second auger 105 extends across the first auger 104 in the right-left direction. The second auger 105 is configured to convey toner left inside the developer unit 100 toward the left outlet 100E.

As depicted in FIG. 3, a partition 106 is disposed between the first auger 104 and the second auger 105. The partition 106 has an opening 106A in a portion thereof facing the first auger 104 and the second auger 105. The opening 106A penetrates the partition 106 in the front-rear direction. The opening 106A extends substantially across the partition 106 in the right-left direction. This configuration allows toner to move to the second auger 105 from the first auger 104 via the opening 106A when excessive toner is supplied to the first auger 104 from the toner storage 121. Therefore, while a constant amount of toner is supplied to the supply roller 102, excessive toner may be returned to the toner storage 121 by the second auger 105.

Figure 6A:
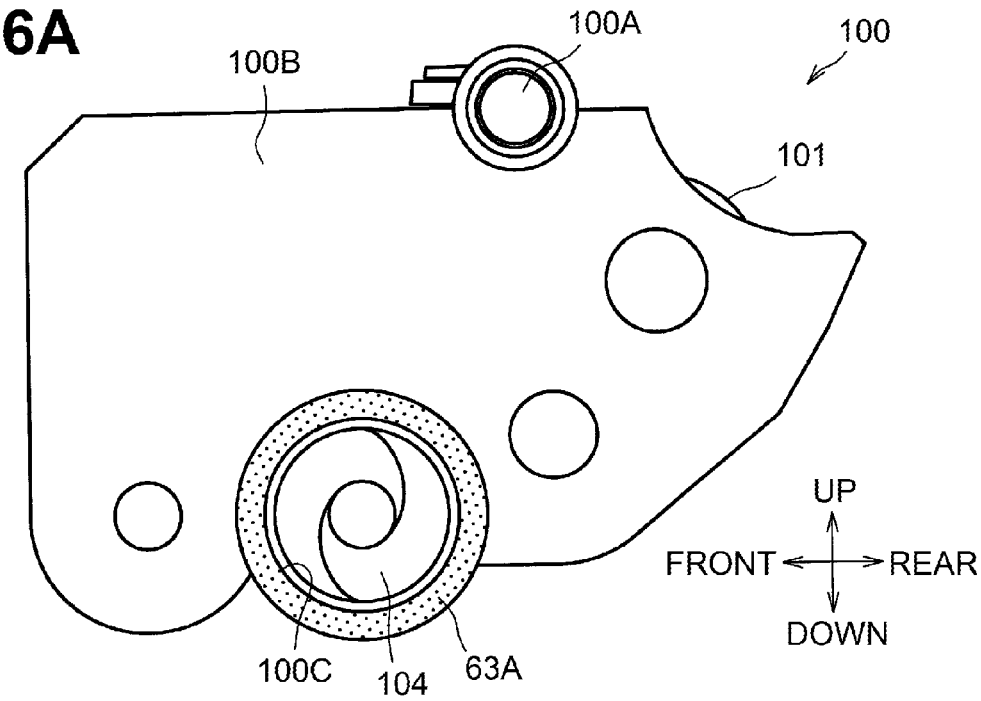
FIG. 6A is a right side view depicting the developer unit in the illustrative embodiment according to one or more aspects of the disclosure.
Figure 6B:
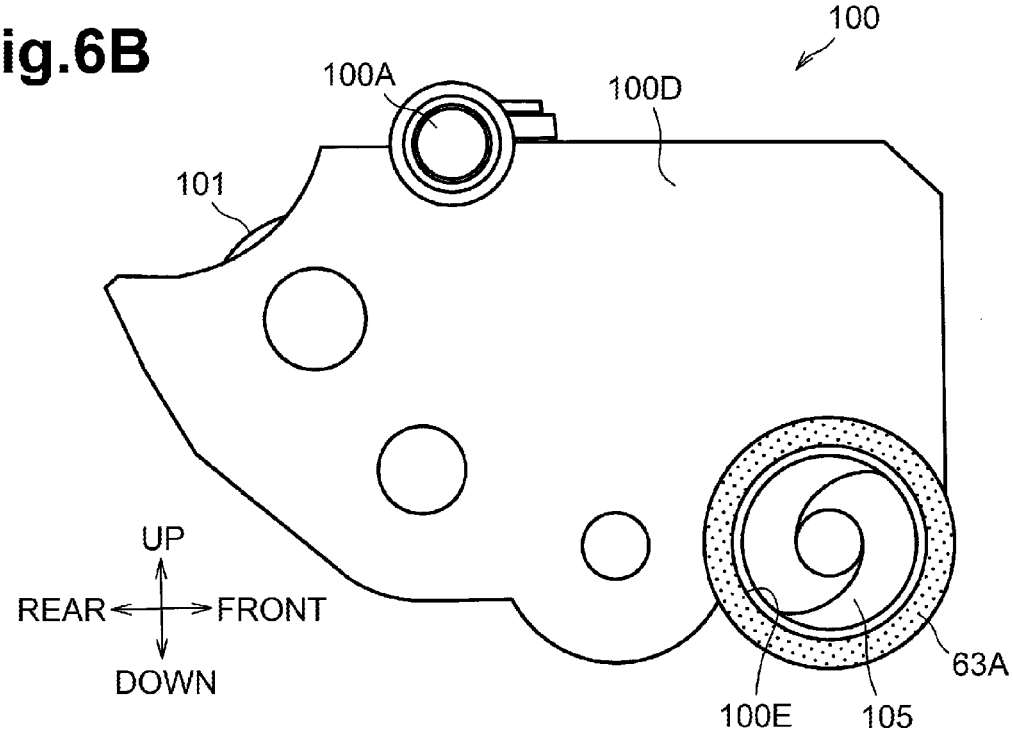
FIG. 6B is a left side view depicting the developer unit in the illustrative embodiment according to one or more aspects of the disclosure.

As depicted in FIGS. 6A and 6B, elastic members 63A are disposed at respective positions corresponding to the inlet 100C and the outlet 100E, respectively, of the developer unit 100. The elastic members 63A may be a cylindrical sponge member. The elastic members 63A are disposed so as to surround the inlet 100C and the outlet 100E, respectively.

As depicted in FIG. 7, elastic members 63B are disposed at respective positions corresponding to the inlet 61B of the right side plate 61A and the outlet 61D of the left side plate 61C, respectively. The elastic members 63B have a configuration similar to the elastic members 63A, and are disposed so as to surround the inlet 61B and the outlet 61D, respectively.

In a state where the developer unit 100 is attached in the process unit 60, the elastic members 63A of the developer unit 100 are in contact the corresponding elastic members 63B of the side plates 61A and 61B to provide a toner passage and the supply pipe 132, the return pipe 142, and the developer unit 100 are in communication with each other via the elastic members 63A and 63B. The elastic members 63A and 63B press each other and thus are disposed in compressed state. With this arrangement, the elastic members 63A and 63B bridge a gap between the inlet 61B and the inlet 100C and a gap between the outlet 61D and the outlet 100E to prevent or reduce leakage of toner at the time of supplying toner from the supply pipe 132 or returning toner to the return pipe 142.

As depicted in FIG. 4, the cleaning unit 110 is connected to a rear end of the connecting plate 62. The cleaning unit 110 includes a cleaning member 111, a first conveying portion 112, and a second conveying portion 113. The first conveying portion 112 and the second conveying portion 113 are an example of a conveyor unit.

The cleaning member 111 includes a blade for collecting or removing toner from the surface of the photosensitive drum 71. A front end portion of the cleaning member 111 is fixed to a first conveyance pipe 112A of the first conveying portion 112 such that a rear end portion of the cleaning member 111 is in contact with an upper surface of the photosensitive drum 71.

The first conveying portion 112 is configured to convey toner collected using the cleaning member 111 toward the second conveying portion 113. The first conveying portion 112 includes a first conveyance pipe 112A and a waste toner auger 112B.

The first conveyance pipe 112A may be a hollow cylinder with closed ends. The first conveyance pipe 112A extends in the right-left direction (e.g. the axial direction of the photosensitive drum 71). The first conveyance pipe 112A is disposed above the photosensitive drum 71. The first conveyance pipe 112A has an opening in a lower surface thereof facing the photosensitive drum 71. The first conveyance pipe 112A is disposed such that the rear end portion of the cleaning member 111 is positioned in the opening of the first conveyance pipe 112A. With this arrangement, toner collected using the cleaning member 111 enters the first conveyance pipe 112A via the opening.

As depicted in FIG. 7, the waste toner auger 112B has a configuration similar to the first auger 104. The waste toner auger 112B is disposed inside the first conveyance pipe 112A and extends across the first conveyance pipe 122A. The waste toner auger 112B is configured to convey toner that enters the first conveyance pipe 112A, from left to right.

The second conveying portion 113 is connected to the toner container unit 120, more specifically, a waste toner storage 122. The waste toner storage 122 is an example of a waste developing agent storage. The second conveying portion 113 includes a second conveyance pipe 113A and a spring auger 113B.

The second conveyance pipe 113A may be a hollow cylinder with one end closed. The second conveyance pipe 113A is connected with a right end (e.g., one end in the axial direction) of the first conveyance pipe 112A and is in communication with the first conveyance pipe 112A. With this configuration, toner conveyed by the waste toner auger 112B enters the second conveyance pipe 113A.

The second conveyance pipe 113A extends frontward (e.g., toward the front of the main body 2) from the right end of the first conveyance pipe 112A. A front end portion of the second conveyance pipe 113A is connectable to a coupling portion 123 of the waste toner storage 122.

The spring auger 113B is connected to a right end of the waste toner auger 112B. The spring auger 113B is configured to rotate to convey toner toward a front end portion of the second conveyance pipe 113A as the waste toner auger 112B rotates.

The second conveyance pipe 113A includes a cover 114A and a coil spring 114C. The second conveyance pipe 113A has an opening 114B. The cover 114A is movable in an attaching/detaching direction of the waste toner storage 122 to close or expose the opening 114B. The cover 114A is an example of a first shutter. The opening 114B is closed or exposed by the cover 114A. The opening 114B is an example of a first opening. The coil spring 114C urges the cover 114A toward a particular position that the cover 114A closes the opening 114B and retains the cover 114A at the particular position.

The cover 114A has a generally cylindrical shape. The cover 114A is disposed so as to be movable frontward and backward relative to a peripheral surface of the second conveyance pipe 113A. More specifically, the cover 114A is configured to be movable between a first exposing position (e.g., a position of the cover 114A depicted in FIG. 3) at which the cover 114A exposes the opening 114B and a first closing position (e.g., a position of the cover 114A depicted in FIG. 4) at which the cover 114A closes the opening 114B.

As depicted in FIG. 4, the opening 114B is defined in a lower surface of a rear end portion of the second conveyance pipe 113A and faces downward. The coil spring 114C is disposed between a rear end of the cover 114A and a flanged portion 113C, which protrudes from the peripheral surface of the second conveyance pipe 113A.

As depicted in FIG. 1, the toner container unit 120 is positioned above the optical path L when the process unit 60 is attached in the main body 2 and is configured to be attachable to and detachable from the process unit 60 (refer to FIG. 4). As depicted in FIG. 4, the toner container unit 120 further includes a waste toner storage 122, a coupling portion 123, a handle 124, and an auger 125. The waste toner storage 122 is configured to store toner collected from the surface of the photosensitive drum 71 using the cleaning member 111. The waste toner storage 122 is disposed behind the toner storage 121.

Similar to the second conveyance pipe 113A, the coupling portion 123 includes a cover 123A and a coil spring 123C at a rear portion of the toner container unit 120, that is, at a rear portion of the waste toner storage 122. The coupling portion 123 has an opening 123B in the rear portion of the waste toner storage 122. The cover 123A is an example of a second shutter. The opening 123B is an example of a second opening.

The cover 123A has a hollow cylindrical shape with a closed end. The toner container unit 120 (e.g., the waste toner storage 122) has a rear end surface 120A with a recess 123D. The cover 123A is disposed within the recess 123D while an open end of the cover 123A faces the recess 123D. The cover 123A is slidable back and forth in the recess 123D. More specifically, the cover 123A is configured to be movable between a second exposing position (e.g., a position of the cover 123A depicted in FIG. 3) at which the cover 123A exposes the opening 123B and a second closing position (e.g., a position of the cover 124A depicted in FIG. 4) at which the cover 123A closes the opening 123B.

The opening 123B is defined in a bottom wall of walls that define inner surfaces of the recess 123D. The opening 123B faces downward. As depicted in FIG. 3, the opening 123B is disposed at a particular position such that the opening 123B corresponds to the opening 114B of the second conveyance pipe 113A when the waste toner storage 122 (e.g., the toner container unit 120) is attached in the cleaning unit 110 (e.g., the process unit 60). The coil spring 123C is disposed between the cover 123A and a bottom of the recess 123D.

Figure 8:
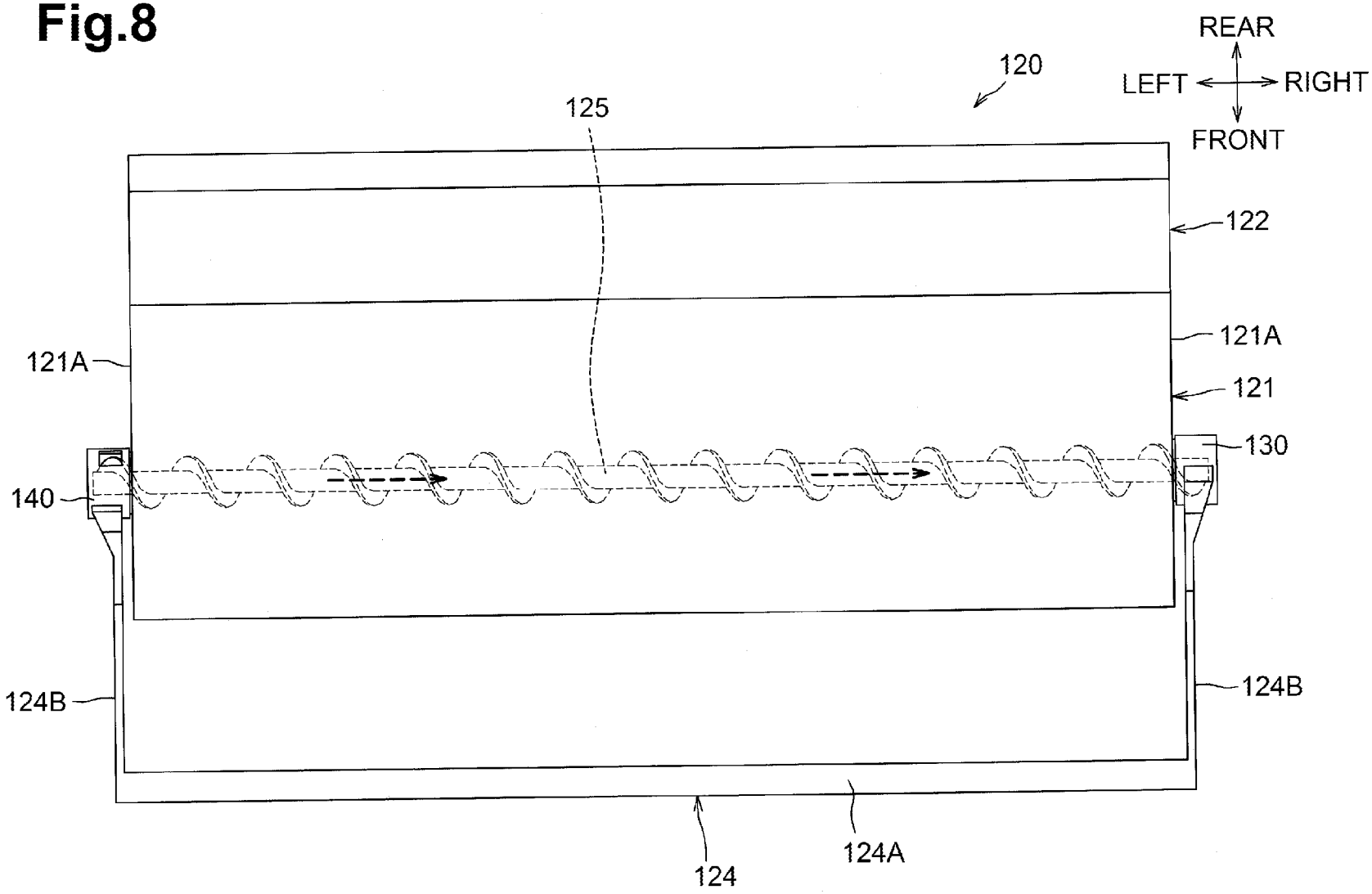
FIG. 8 is a top plan view depicting the toner container unit in the illustrative embodiment according to one or more aspects of the disclosure.

As depicted in FIG. 8, the handle 124 includes a grip portion 124A and arm portions 124B. The grip portion 124A extends in the right-left direction. The arm portions 124B extend from respective right and left ends of the grip portion 124A toward right and left side surfaces 121A, respectively, of the toner storage 121. The handle 124 is pivotable on respective rotating portions 130 and 140 provided at respective ends of the arm portions 124B. More specifically, the handle 124 is configured to pivot between a removable position (e.g., a position of the handle 124 depicted in FIGS. 9A and 10A) at which the toner container unit 120 is allowed to be removed from the process unit 60 and a fixing position (e.g., a position of the handle 124 depicted in FIGS. 9B and 10B) that is lower than the removable position in the up-down direction and at which the toner container unit 120 is fixed to the process unit 60.

Figure 9A:
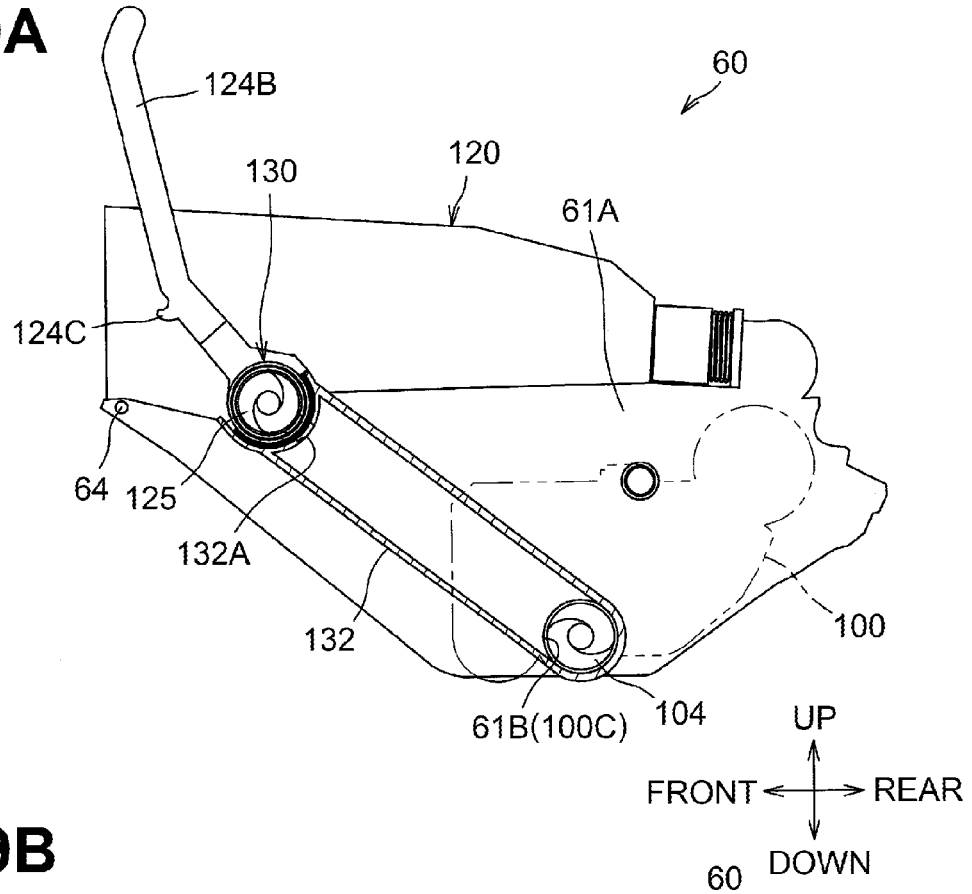
FIG. 9A is a sectional view of the process unit taken along line X-X in FIG. 7 in the illustrative embodiment according to one or more aspects of the disclosure, wherein the toner container unit is attached in the process unit and a handle is located at a removable position.
Figure 9B:
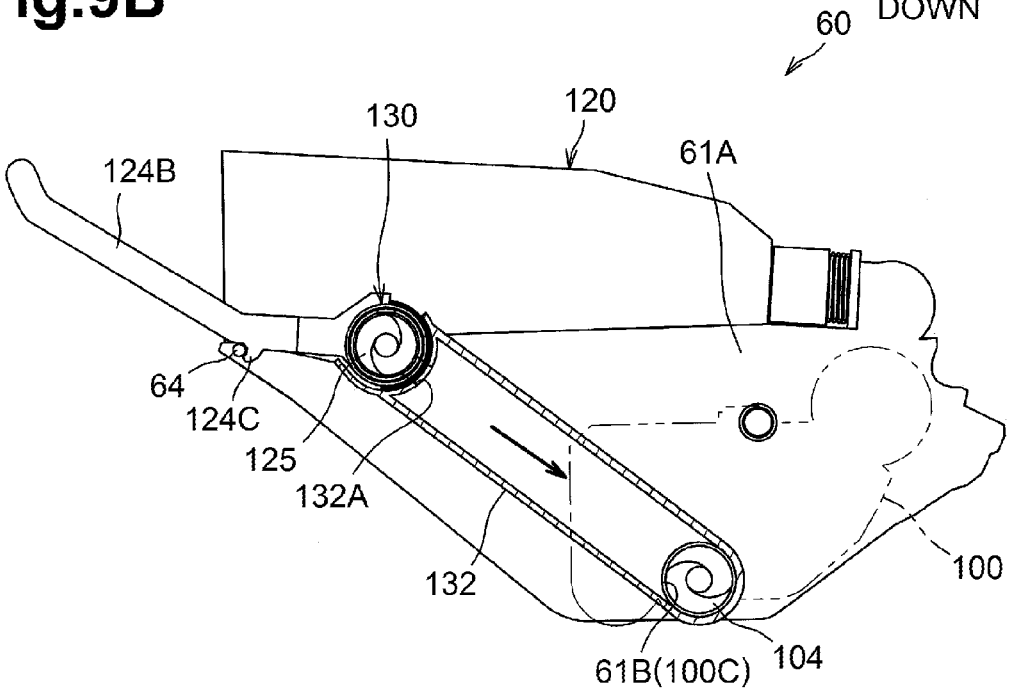
FIG. 9B is a sectional view of the process unit taken along line X-X in FIG. 7 in the illustrative embodiment according to one or more aspects of the disclosure, wherein the toner container unit is attached in the process unit and the handle is located at a fixing position.

As depicted in FIGS. 9A and 9B, the arm portions 124B (only the right arm 124B is depicted) each include an engagement portion 124C. The engagement portions 124C are configured to engage with respective pins 64, each of which protrudes rightward or leftward from an outer surface of one of the side plates 61A and 61B. The engagement portions 124C are in engagement with the respective pins 64 when the handle 124 is located at the fixing position, thereby fixing the toner container unit 120 to the process unit 60 when the handle 124 is located at the fixing position. The left engagement portion 124C has the same configuration as the right engagement portion 124C (refer to FIGS. 10A and 10B).

As depicted in FIG. 8, the auger 125 has a similar configuration to the first auger 104. The auger 125 extends across the toner storage 121 in the right-left direction, more specifically, the auger 125 extends from the right rotating portion 130 to the left rotating portion 140. The auger 125 is disposed at a position corresponding to the right rotating portion 130 and the left rotating portion 140. The auger 125 is configured to convey toner from left to right, that is, from the left rotating portion 140 toward the right rotating portion 130, as the auger 125 rotates.

Figure 11A:
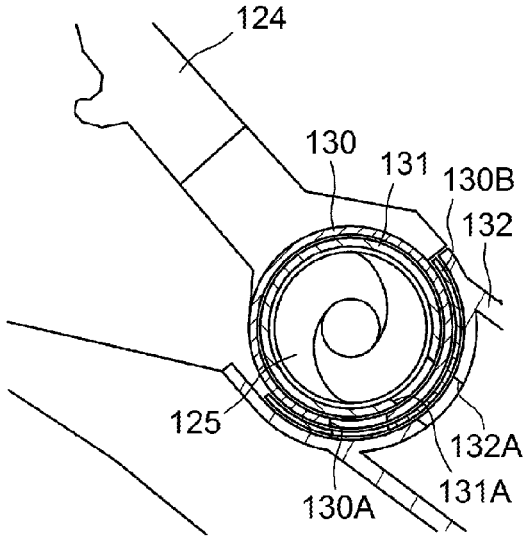
FIG. 11A is an enlarged view depicting a right rotating portion of FIG. 9A in the illustrative embodiment according to one or more aspects of the disclosure.
Figure 11B:
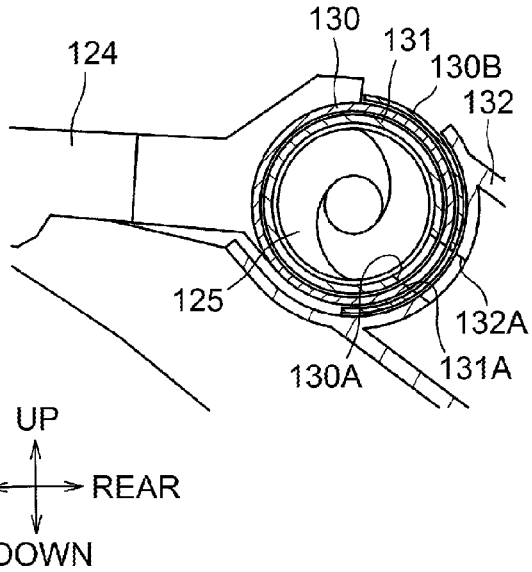
FIG. 11B is an enlarged view depicting the right rotating portion of FIG. 9B in the illustrative embodiment according to one or more aspects of the disclosure.

As depicted in FIGS. 11A and 11B, each of the right and left rotating portions 130 and 140 is a hollow cylinder with a closed end. That is, the right and left rotating portions 130 and 140 have a space inside thereof extending in the right-left direction. The right and left rotating portions 130 are configured to allow the toner storage 121 and the developer unit 100 to communicate with each other via the supply pipe 132 and the return pipe 142. The right and left rotating portions 130 and 140 include right and left cylindrical portions 131 and 141, respectively. The right and left cylindrical portions 131 and 141 are disposed along inner surfaces of the right and left rotating portions 130 and 140, respectively.

As depicted in FIG. 11A, the right rotating portion 130 has a first inlet 130A defined in a lower end portion thereof. The position of the first inlet 130A changes between a first position (e.g., a position of the first inlet 130A depicted in FIG. 11A) and a second position (e.g., a position of the first inlet 130A depicted in FIG. 11B) in response to the pivoting of the handle 124 between the removal position and the fixing position. When the handle 124 is located at the removable position, the first inlet 130A is positioned at the first position at which the first inlet 130A faces generally downward. When the handle 124 is located at the fixing position, the first inlet 130A is positioned at the second position that is an obliquely upper rear position with respect to the first position. A slide-contact member 130B is disposed around the periphery of the right rotating portion 130 so as to face the first inlet 130A. The slide-contact member 130B slides over the supply pipe 132 while being in contact with the supply pipe 132 when the right rotating portion 130 rotates.

The right cylindrical portion 131 is fixed to, for example, the right side surface 121A of the toner storage 121, so as not to rotate in response to pivoting of the handle 124. The right cylindrical portion 131 has a second inlet 131A. The second inlet 131A is defined in a lower end portion of the right cylindrical portion 131 and faces obliquely downward toward the rear. The second inlet 131A is defined in the portion where the second inlet 131A coincides with the first inlet 130A when the handle 124 is located at the fixing position, that is, when the first inlet 130A is located at the second position.

Figure 11C:
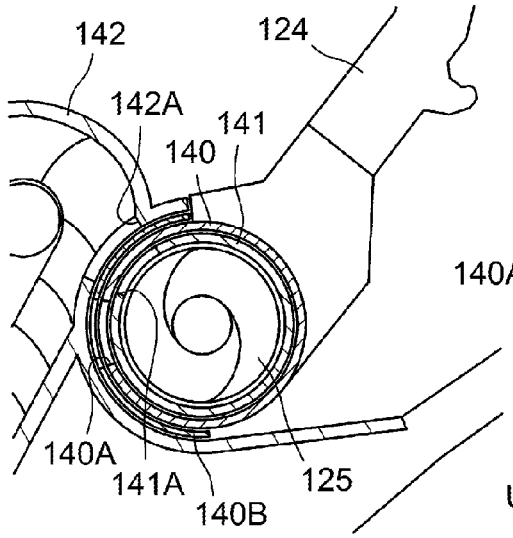
FIG. 11C is an enlarged view depicting a left rotating portion of FIG. 10A in the illustrative embodiment according to one or more aspects of the disclosure.

As depicted in FIG. 11C, the left rotating portion 140 has a first outlet 140A. The position of the first outlet 140A changes between a third position (e.g., a position of the first outlet 140A depicted in FIG. 11C) and a fourth position (e.g., a position of the first outlet 140A depicted in FIG. 11D). When the handle 124 is located at the removable position, the first outlet 140A is positioned at the third position at which the first outlet 140A is positioned at a rear end portion of the left rotating portion 140 and faces generally rearward. When the handle 124 is located at the fixing position, the first outlet 140A is positioned at the fourth position that is an obliquely upper rear position with respect to the third position. A slide-contact member 140B is disposed around the periphery of the left rotating portion 140 so as to face the first outlet 140A. The slide-contact member 140B slides over the return pipe 142 while being in contact with the return pipe 142 when the left rotating portion 140 rotates.

The left cylindrical portion 141 is fixed to, for example, the left side surface 121A of the toner storage 121, so as not to rotate in response to pivoting of the handle 124. The left cylindrical portion 141 has a second outlet 141A. The second outlet 141A is defined in an upper end portion of the left cylindrical portion 141 and faces obliquely upward toward the rear. The second outlet 141A is defined in the portion where the second outlet 141A coincides with the first outlet 140A when the handle 124 is located at the fixing position, that is, when the first outlet 140A is located at the fourth position.

In a state where the toner container unit 120 is attached to the process unit 60, the right rotating portion 130 is positioned corresponding to the supply pipe 132 that is disposed at an exterior of the right side plate 61A of the process unit 60 while the left rotating portion 140 is positioned corresponding to the return pipe 142 that is disposed at an exterior of the left side plate 61C of the process unit 60.

The supply pipe 132 is in communication with the developer unit 100 via the inlets 61B and 100C. The supply pipe 132 extends obliquely downward toward the rear from a position that is closer to a lower rear portion of the right rotating portion 130 to a position corresponding to the first auger 104 (e.g., the inlets 61B and 100C).

As depicted in FIGS. 11A and 11B, the supply pipe 132 has an inlet 132A. The inlet 132A is defined in an upper end portion of the supply pipe 132 and adjacent to the right rotating portion 130. The inlet 132A is disposed to coincide with the second inlet 131A of the right cylindrical portion 131.

Figure 10A:
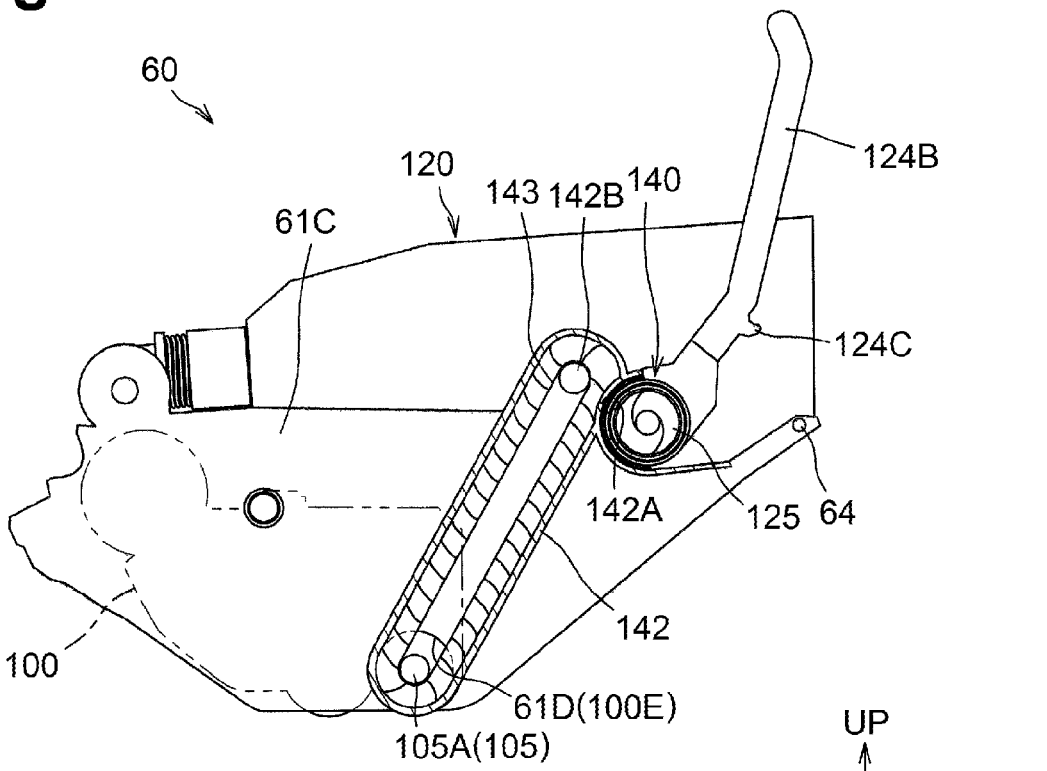
FIG. 10A is a sectional view of the process unit taken along line Y-Y in FIG. 7 in the illustrative embodiment according to one or more aspects of the disclosure, wherein the toner container unit is attached in the process unit and the handle is located at the removable position.
Figure 10B:
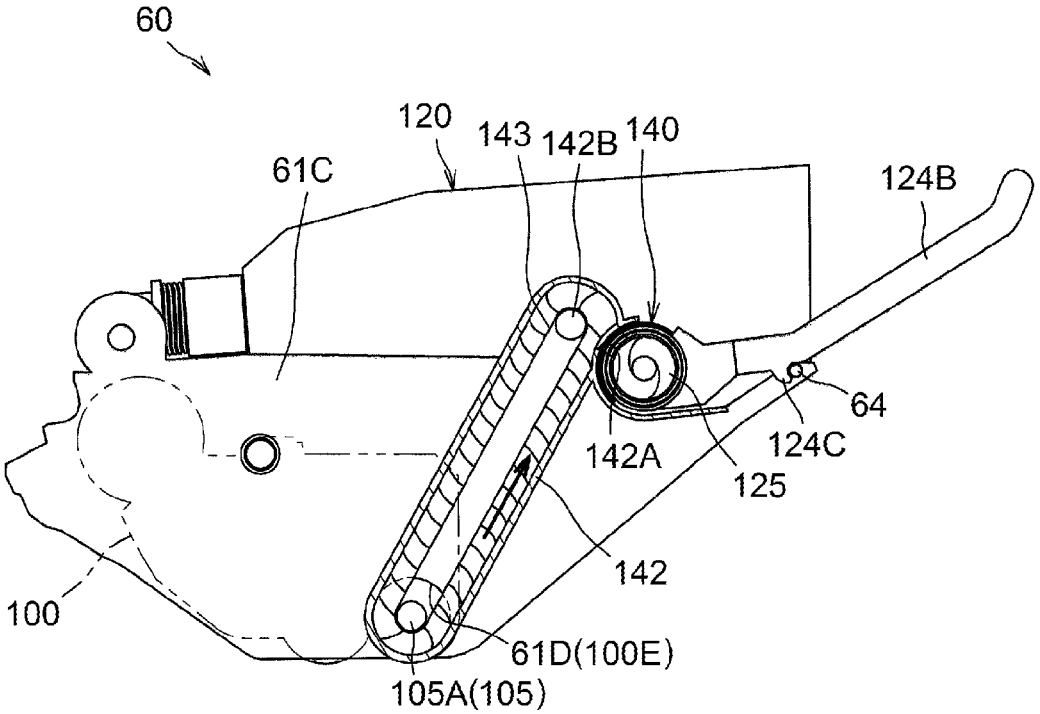
FIG. 10B is a sectional view of the process unit taken along line Y-Y in FIG. 7 in the illustrative embodiment according to one or more aspects of the disclosure, wherein the toner container unit is attached in the process unit and the handle is located at the fixing position.

As depicted in FIGS. 10A and 10B, the return pipe 142 is in communication with the developer unit 100 via the outlets 61D and 100E. The return pipe 142 extends obliquely upward toward the front from a position corresponding to the second auger 105 to a position that is closer to a rear portion of the left rotating portion 14. The return pipe 142 has an outlet 142A. The outlet 142A is defined in an upper end portion of the return pipe 1442 and adjacent to the left rotating portion 140. The outlet 142A is disposed to coincide with the second outlet 141A of the left cylindrical portion 131.

The return pipe 142 includes a conveyor belt 143 inside thereof. The conveyor belt 143 is disposed along an internal surface of the return pipe 142. The conveyor belt 143 is an endless belt. The conveyor belt 143 extends between a shaft 142B and a rotating shaft 105A of the second auger 105. The shaft 142B is disposed at an upper end portion of the return pipe 142.

The conveyor belt 143 includes a plurality of protrusions protruding from an outer peripheral surface for catching and carrying toner entering the return pipe 142. As the conveyor belt 143 rotates in a direction of an arrow in FIG. 10B, the conveyor belt 143 conveys toner upward. As described above, the conveyor belt 143 conveys toner entering the return pipe 142 from the developer unit 100 to return the toner to the toner storage 121.

Effects obtained by the laser printer 1 configured as described above will be described.

When the toner storage 121 becomes empty of toner, a user opens the top cover 21 of the laser printer 1 and removes the toner container unit 120 from the main body 2 via the opening 21A for replacing the toner container unit 120 with a new one. At the time of removing the toner container unit 120 from the process unit 60, the user holds the grip portion 124A of the handle 124 of the toner storage 121 and then pivots the handle 125 from the fixing position to the removable position. In response to the pivoting of the handle 125, as depicted in FIGS. 9 and 10, the engagement portions 124C of the arm portions 124B are disengaged from the corresponding pins 64 of the process unit 60, and thus, the toner container unit 120 is allowed to be removed from the process unit 60.

In response to the pivoting of the handle 124 to the removable position, as depicted in FIG. 11A, the right rotating portion 130 rotates and thus the position of the first inlet 130A changes to the first position, whereby a portion of a wall of the right rotating portion 130 closes the second inlet 131A of the right cylindrical portion 131. Further, in response to this, as depicted in FIG. 11C, the left rotating portion 140 rotates and thus the position of the first outlet 140A changes to the third position, whereby a portion of a wall of the left rotating portion 140 closes the second outlet 141A of the left cylindrical portion 141. Therefore, the communication between the toner storage 121 and the supply pipe 132 and between the toner storage 121 and the return pipe 142 is interrupted, whereby toner leakage from the toner container unit 120 may be reduced or prevented when the toner container unit 120 is removed from the process unit 60.

As depicted in FIG. 4, in response to removal of the toner container unit 120 from the process unit 60 using the handle 124, the cover 114A moves from the first exposing position to the first closing position and the cover 123A moves the second exposing position to the second closing position. Thus, at the time of attaching and detaching the toner container unit 120 to the process unit 60, toner leakage from a joint between the waste toner storage 122 and the cleaning unit 110 may be reduced or prevented.

When a toner storage is replaced with a new one several times, an amount of toner wasted increases. If, however, a process unit has a configuration in which only the toner storage is replaceable, a waste toner storage of the process unit may need to have larger capacity for waste toner.

In the illustrative embodiment, the toner container unit 120 including the toner storage 121 and the waste toner storage 122 is replaceable with a new one. Therefore, when the toner container unit 120 is replaced with a new one, both of the waste toner storage 122 and the toner storage 121 are replaced with new ones. Thus, the waste toner storage 122 of the process unit 60 according to the illustrative embodiment may have smaller capacity than the process unit in which the waste toner storage is not replaceable. Accordingly, the toner storage capacity of the toner storage 121 may be increased through the use of the space above the optical path L.

Figure 2:
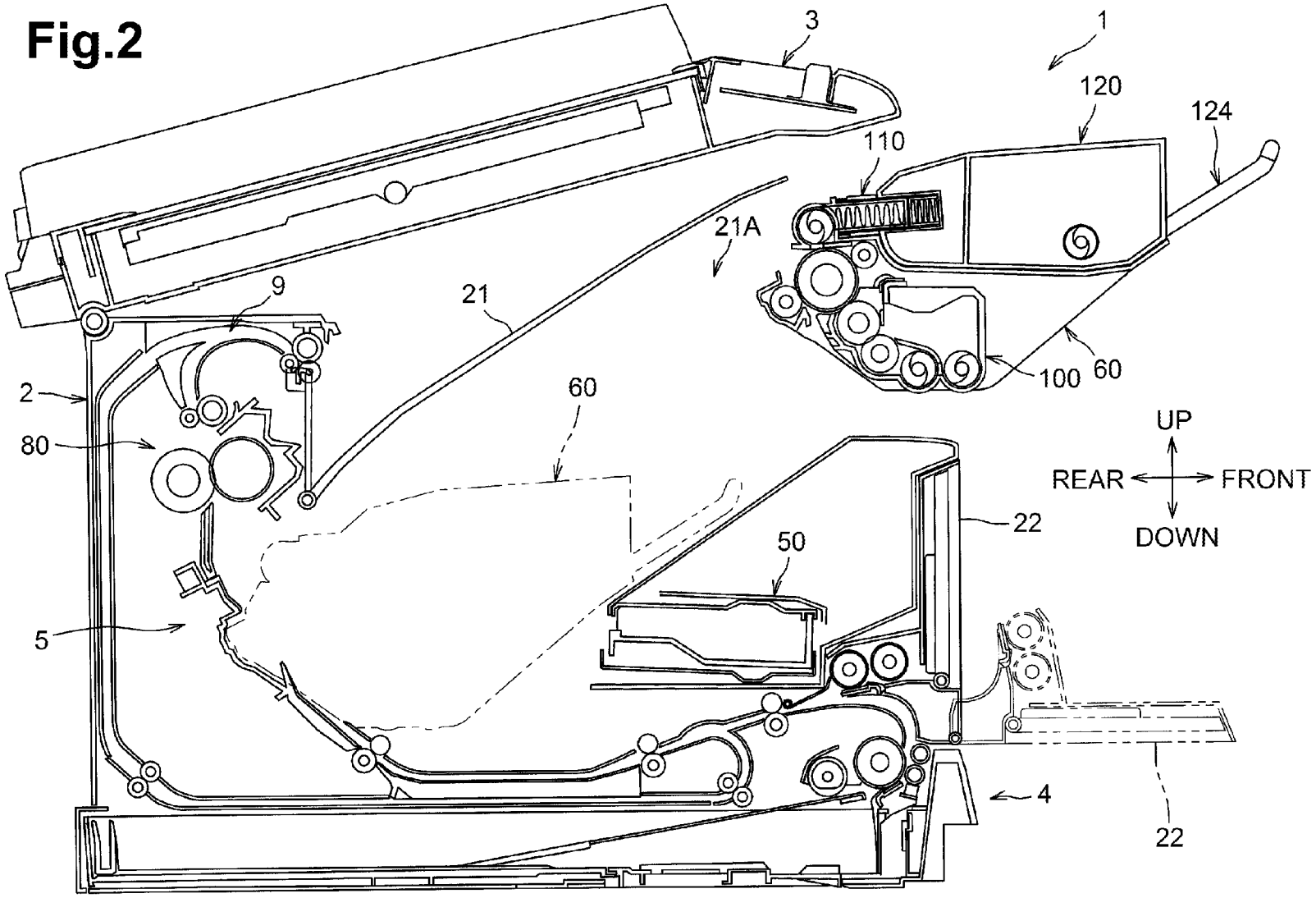
FIG. 2 is a diagram for explaining attachment and detachment of the process unit with respect to a main body of the laser printer in the illustrative embodiment according to one or more aspects of the disclosure.

As depicted in FIG. 2, at the time of attaching a new toner container unit 120 to the process unit 60, the toner container unit 120 is inserted into the main body 2 via the opening 21A and the coupling portion 123 of the waste toner storage 122 is connected to the second conveyance pipe 113A of the cleaning unit 110. At that time, as depicted in FIG. 3, the cover 114A is urged rearward against an urging force of the coil spring 114C by the rear end surface 120A that has the recess 123D in which the cover 123A of the waste toner storage 122 is disposed while the cover 123A is urged frontward against an urging force of the coil spring 123C by the second conveyance pipe 113A. That is, the cover 114A moves from the first closing position to the first exposing position while pressing and contracting the coil spring 114C and the cover 123A moves from the second closing position and the second exposing position while pressing and contracting the coil spring 123C.

The coupling portion 123 of the waste toner storage 122 engages with the front end portion of the second conveyance pipe 113A. Thus, the opening 114B of the second conveyance pipe 113A coincides with the opening 123B of the waste toner storage 122, whereby the second conveyance pipe 113A and the waste toner storage 122 become in communication with each other.

After the toner container unit 120 and the cleaning unit 110 are joined to each other, the handle 124 is pivoted to the fixing position to engage the engagement portions 124C of the arm portions 124B with the corresponding pins 64 of the process unit 60. Thus, the toner container unit 120 is completely attached to the process unit 60.

Figure 11D:
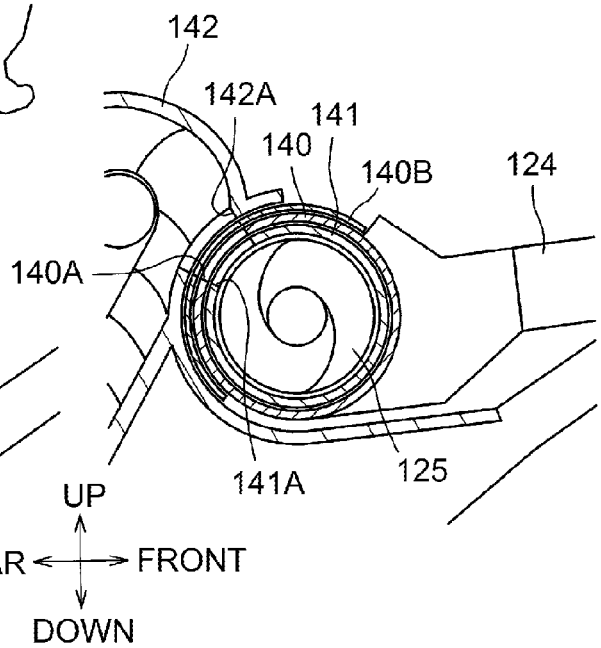
FIG. 11D is an enlarged view depicting the left rotating portion of FIG. 10B in the illustrative embodiment according to one or more aspects of the disclosure.

In response to the pivoting of the handle 124 to the fixing position, as depicted in FIG. 11B, the right rotating portion 130 rotates such that the position of the first inlet 130A changes to the second position. Thus, the first inlet 130A, the second inlet 131A, and the inlet 132A coincide with each other, whereby the toner storage 121 and the supply pipe 132 become in communication with each other. As depicted in FIG. 11D, the left rotating portion 140 also rotates such that the position of the first outlet 140A changes to the fourth position. Thus, the first outlet 140A, the second outlet 141A, and the outlet 142A coincide with each other, whereby the toner storage 121 and the return pipe 142 become in communication with each other.

Therefore, toner is supplied to the developer unit 100 from the toner storage 121 via the supply pipe 132 by the auger 125 and is returned to the toner storage 121 from the developer unit 100 via the return pipe 142. Toner returned to the left rotating portion 140 is then conveyed to the right rotating portion 130 by the auger 125 and is again supplied to the developer unit 100. Thus, toner may circulate between the inside of the toner container unit 120 and the developer unit 100 and may be effectively recycled.

The toner container unit 120 is disposed on the connecting plate 62. This arrangement may enable to the connecting plate 62 to stably support the toner container unit 120 having a relatively larger size thereon.

The developer unit 100 is pivotable with respect to the side plates 61A and 61B. Therefore, a stable movement of the developer unit 100 with respect to the side plates 61A and 61B may be ensured. Thus, the developing roller 101 may be pressed toward the photosensitive drum 71 uniformly using a spring.

The second conveyance pipe 113A and the waste toner storage 122 are in communication with each other via the respective openings 114B and 123B that face downward. Toner conveyed toward the front end portion of the second conveyance pipe 113A by the waste toner auger 112B and the spring auger 113B may enter the waste toner storage 122 via the openings 114B and 123B by its own weight.

While the disclosure has been described in detail with reference to example embodiments thereof, it is not limited to such examples. Various changes, arrangements and modifications may be applied to the detailed configuration without departing from the spirit and scope of the disclosure.

In the illustrative embodiment, the developer unit 100 is configured to be pivotable with respect to the side plates 61A and 61B. Nevertheless, in other embodiments, for example, the developer unit 100 might not be configured to be pivotable with respect to the side plates 61A and 61B.

In the illustrative embodiment, the toner container unit 120 is disposed on the connecting plate 62. Nevertheless, in other embodiments, for example, the toner container unit 120 may be supported by side frames of the main body 2.

In the illustrative embodiment, the monochrome laser printer 1 is illustrated as the image forming apparatus. Nevertheless, in other embodiments, the image forming apparatus may include, for example, a copying machine.

What is claimed is:

1. An image forming apparatus comprising:

a main body including a first end portion and a second end portion;

a process unit disposed at the first end portion of the main body and including a photosensitive drum and a developing roller;

an exposure unit disposed at the second end portion of the main body and configured to expose the photosensitive drum, an optical path of light irradiated from the exposure unit extending above the developing roller; and a developing agent container unit including: a developing agent storage configured to store a developing agent; and a waste developing agent storage configured to store the developing agent collected from a surface of the photosensitive drum, the developing agent container unit being disposed above the optical path and being detachably attachable to the process unit such that the developing agent storage disposed above the optical path and the waste developing agent storage disposed above the optical path are integrally detachable from the process unit.

2. The image forming apparatus according to claim 1, wherein the process unit includes:

a cleaning member configured to collect the developing agent from the surface of the photosensitive drum; and a conveyor unit configured to convey the developing agent collected using the cleaning member toward the waste developing agent storage, wherein the conveyor unit includes:

a first conveying portion extending in an axial direction of the photosensitive drum and configured to convey the developing agent to one end of the first conveying portion in the axial direction; and a second conveying portion extending from the one end of the first conveying portion along a direction extending from the first end portion to the second end portion of the main body and configured to be connected to the waste developing agent storage.

3. The image forming apparatus according to claim 2, wherein the second conveying portion has a first opening and includes a first shutter configured to move between a first opening position at which the first shutter opens the first opening and a first closing position at which the first shutter closes the first opening, wherein the waste developing agent storage has a second opening defined in a particular portion corresponding to the first opening when the developing agent container unit is attached to the process unit, and includes a second shutter configured to move between a second opening position at which the second shutter opens the second opening and a second closing position at which the second shutter closes the second opening, wherein the first shutter is configured to:

move from the first closing position to the first opening position in response to attachment of the developing agent container unit to the process unit; and move from the first opening position to the first closing position in response to detachment of the developing agent container unit from the process unit, and wherein the second shutter is configured to:

move from the second closing position to the second opening position in response to attachment of the developing agent container unit to the process unit; and move from the second opening position to the second closing position in response to detachment of the developing agent container unit to the process unit.

4. The image forming apparatus according to claim 2, wherein the cleaning member contacts the surface of the photosensitive drum from above and includes a blade configured to collect or remove the developing agent from the surface of the photosensitive drum.

5. The image forming apparatus according to claim 1, wherein the process unit further includes:

a developer unit including the developing roller; and side plates disposed to define both sides of the process unit in an axial direction of the photosensitive drum, and supporting the developer unit so as to be pivotable.

6. The image forming apparatus according to claim 1, wherein the process unit includes:

side plates disposed to define both sides of the process unit in an axial direction of the photosensitive drum; and a connecting plate connecting upper end portions of the side plates with each other, wherein the developing agent container unit is disposed on the connecting plate.

7. The image forming apparatus according to claim 1, further comprising:

a feed tray disposed below the process unit;

a discharge tray disposed above the process unit;

a first guide configured to guide a recording sheet fed from the feed tray to the process unit after bending the recording sheet into a generally U-shape at the second end portion of the main body; and a second guide configured to guide the recording sheet, which has passed the process unit, to the discharge tray after bending the recording sheet into a generally U-shape at the first end portion of the main body.

8. The image forming apparatus according to claim 1, wherein the optical path extends substantially horizontally.

9. The image forming apparatus according to claim 1, wherein at least a portion of the exposure unit is positioned below the process unit and the developing agent container unit in a state where the process unit and the developing agent container unit are attached in the main body.

10. The image forming apparatus according to claim 1, wherein, in a side view of the main body, the exposure unit is positioned in a front half portion of the main body, and the process unit and the developing agent container unit are positioned in a rear half portion of the main body in a state where the process unit and the developing agent container unit are attached in the main body.

11. The image forming apparatus according to claim 1, wherein, in a side view of the main body, the exposure unit is positioned in a diagonally lower half portion of the main body, and the process unit and the developing agent container unit are positioned in a diagonally upper half portion of the main body in a state where the process unit and the developing agent container unit are attached in the main body.

12. The image forming apparatus according to claim 1, wherein the process unit and the developing agent container unit are configured to be integrally attached to and detached from the main body.

13. An image forming apparatus comprising:

a main body including a first end portion and a second end portion;

a process unit disposed at the first end portion of the main body and including a photosensitive drum and a developing roller;

an exposure unit disposed at the second end portion of the main body and configured to expose the photosensitive drum; and a developing agent container unit including: a developing agent storage configured to store a developing agent; and a waste developing agent storage configured to store the developing agent collected from a surface of the photosensitive drum, the developing agent container unit being positioned above the process unit and being detachably attachable to the process unit such that the developing agent storage postitoned above the process unit and the waste developing agent storage positioned above the process unit are integrally detachable from the process unit, wherein a space through which light irradiated from the exposure unit passes is formed above the developing roller and below the developing agent container unit which includes the developing agent storage and the waste developing agent storage.

14. The image forming apparatus according to claim 13, wherein the space extends substantially horizontally.

15. An image forming apparatus comprising:

a main body including a first end portion and a second end portion;

a process unit disposed at the first end portion of the main body and including a photosensitive drum and a developing roller;

an exposure unit disposed at the second end portion of the main body and configured to expose the photosensitive drum; and a developing agent container unit including: a developing agent storage configured to store a developing agent; and a waste developing agent storage configured to store the developing agent collected from a surface of the photosensitive drum, the developing agent container unit being detachably attachable to the process unit, wherein an exposed position on the photosensitive drum, which is exposed by the exposure unit, is positioned above the developing roller and below the developing agent container unit which includes the developing agent storage and the waste developing agent storage, and the developing agent storage postitoned above the exposed postiton and the waste developing agent storage positioned above the exposed position are integrally detachable form the process unit.

16. The image forming apparatus according to claim 15, wherein a line connecting the exposed position and the exposure unit extends substantially horizontally.

* * * * *